US011541524B2

(12) United States Patent
Imfeld et al.

(10) Patent No.: US 11,541,524 B2
(45) Date of Patent: Jan. 3, 2023

(54) TOOL-HOLDING DEVICE, WORK MACHINE WITH THE TOOL-HOLDING DEVICE, AS WELL AS A METHOD FOR POSITIONING A TOOL ON A TOOL-HOLDING DEVICE

(71) Applicant: SCHLEUNIGER AG, Thun (CH)

(72) Inventors: Ruedi Imfeld, Steinhausen (CH); Klemens Imholz, Zug (CH); Marco Bürgisser, Cham (CH)

(73) Assignee: Schleuniger AG, Thun (CH)

( * ) Notice: Subject to any disclaimer, the term of this patent is extended or adjusted under 35 U.S.C. 154(b) by 6 days.

(21) Appl. No.: 16/991,461

(22) Filed: Aug. 12, 2020

(65) Prior Publication Data

US 2021/0046597 A1 Feb. 18, 2021

(30) Foreign Application Priority Data

Aug. 13, 2019 (EP) ..... 19191585

(51) Int. Cl.
*B25D 17/08* (2006.01)

(52) U.S. Cl.
CPC ..... *B25D 17/08* (2013.01); *B25D 2217/0038* (2013.01); *Y10T 279/17761* (2015.01)

(58) Field of Classification Search
CPC ..... B25D 17/08; B25D 17/088; B25D 2217/0038; B25D 2217/003; B25D 2217/0034; Y10T 279/17761; Y10T 279/17393; Y10T 279/17863; Y10T 279/33; H02G 1/1265; H02G 1/1268; H02G 1/1251; H02G 1/1248; B23B 31/10; B23B 31/19
See application file for complete search history.

(56) References Cited

U.S. PATENT DOCUMENTS 1,592,851 A * 7/1926 Hansen ..... B25D 17/08 279/19.5
1,605,435 A * 11/1926 Hansen ..... B25D 17/08 173/133
1,646,090 A * 10/1927 Hansen ..... B25D 17/08 279/19
(Continued)

FOREIGN PATENT DOCUMENTS

DE 443791 C * 5/1927
DE 39 32 629 A1 4/1990
(Continued)

OTHER PUBLICATIONS

European Search Report Corresponding to EP19191585 dated Jan. 17, 2020.

*Primary Examiner* — Chwen-Wei Su
(74) *Attorney, Agent, or Firm* — Finch & Maloney PLLC

(57) ABSTRACT

A tool-holding device (11) for holding a tool (13) on a work machine with a retaining unit (20) and with a lock unit (30). The lock unit (30) can be transferred from a receiving position into a fixing position, and the retaining unit (20) comprises a receiving section (21) for holding the lock unit (30) at least in sections. The lock unit (30) comprises a tool-holding section (33) for holding a tool (13) in a pre-positioned manner. A work machine with this tool-holding device and a method for positioning a tool (13) on a work machine are also disclosed.

14 Claims, 5 Drawing Sheets

(56) References Cited

U.S. PATENT DOCUMENTS

| | | | | |
|---|---|---|---|---|
| 1,810,900 | A * | 6/1931 | Bormann | B23K 9/282 279/44 |
| 4,176,991 | A * | 12/1979 | Egli | B23B 31/103 408/239 R |
| 4,646,604 | A | 3/1987 | Schink | |
| 5,022,256 | A | 6/1991 | van der Meulen | |
| 9,061,410 | B2 * | 6/2015 | Zhou | B23B 31/19 |
| 9,486,934 | B2 * | 11/2016 | Zhou | B23Q 3/14 |
| 2018/0345351 | A1 | 12/2018 | Natoli et al. | |

FOREIGN PATENT DOCUMENTS

| | | | |
|---|---|---|---|
| DE | 296 17 574 | U1 | 2/1998 |
| DE | 103 57 652 | A1 | 7/2005 |
| EP | 0 180 146 | A2 | 5/1986 |
| GB | 2 409 422 | A | 6/2005 |
| JP | S56-80916 | U | 6/1981 |

* cited by examiner

TOOL-HOLDING DEVICE, WORK MACHINE WITH THE TOOL-HOLDING DEVICE, AS WELL AS A METHOD FOR POSITIONING A TOOL ON A TOOL-HOLDING DEVICE

This application claims priority from European patent application serial no. 19191585.9 filed Aug. 13, 2019.

FIELD OF THE INVENTION

The invention relates to a tool-holding device, a work machine with the tool-holding device and a method for positioning a tool on a tool-holding device.

BACKGROUND OF THE INVENTION

The conversion from a first tool to another tool in a work machine, using which different workpieces are machined, usually requires a stopping of the work machine. In order to ensure that a standstill of the work machine scarcely plays an overall role in the industrial production of workpieces, the user of the machine must be able to carry out the conversion of the machine from a first tool to another tool with a minimal expenditure of time.

In the case of cable processing machines, the manufacturing processes are carried out semi-automatically so that the user of a cable processing machine must be able to arrange a tool at the appropriate location on the work machine in a quick and error-free manner.

DE 103 57 652 A1 discloses a machine tool with a housing and a quick lock for attaching a rotating tool to the housing, wherein the quick lock consists of two locking parts. One of the locking parts is arranged on the housing and the other locking part is arranged in the tool. The housing comprises a receiving section for at least sectional holding of one of the two locking parts of the quick lock.

The disadvantage of this well-known solution is that, the user of the machine tool requires a plurality of handles for arranging and attaching the tool in order to engage the two locking parts with one another when assembling the tool, as well as requiring a plurality of handles for detaching and removing the tool in order to disengage the two locking parts during disassembly.

SUMMARY OF THE INVENTION

It is the object of the present invention to remedy one or a plurality of disadvantages of prior art. In particular, a tool-holding device should be created, by means of which the ergonomic handling is improved when changing tools on a tool-holding device. Furthermore, a work machine with a tool-holding device, as well as a method for positioning a tool on a tool-holding device should be created so that a tool can be arranged on a tool-holding device in an easy and time-saving manner.

This task is achieved by means of the devices and method defined in the independent patent claims. Favourable further embodiments are illustrated in the figures, the description and, in particular, in the dependent patent claims.

A tool-holding device according to the invention for holding a tool on a work machine comprises a retaining unit and a lock unit, wherein the lock unit can be transferred from a receiving position into a fixing position, and wherein the retaining unit comprises a receiving section for holding the lock unit at least in sections. The lock unit comprises a tool-holding section for the pre-positioned holding of a tool.

The user of the work machine can easily position the tool into the tool-holding section of the lock unit with one hand, wherein the lock unit is in the receiving position during this positioning of the tool, and the tool is held in the tool-holding section in a pre-positioned manner. It is possible to arrange the tool on the lock unit without a direct view of the tool-holding section by the user. In the present document, by pre-positioned holding, an independent holding of the tool on the tool-holding section of the lock unit is understood so that the tool sits in the tool-holding section in a self-locking (non-positive) and/or positive-locking and/or magnetic manner. Thereby, the tool can be held in an independent and play-free manner on the tool-holding section of the lock unit before transferring the lock unit into the fixing position without the user having to hold the tool. The pre-positioned holding of the tool makes it easier for the user to change tools on the work machine, since this can prevent the tool from falling out of the tool-holding section. This ensures ergonomic handling.

In particular, on a cable processing machine as a work machine, the tool can be removed with the aid of this tool-holding device. The processing of cables in industry requires a particularly well-trained user, who must be highly concentrated over the course of several hours to speed up the manufacturing process. Therefore, the previously described tool-holding device is particularly suitable to provide relief for the user of a cable processing machine.

Favourably, the lock unit can be transferred from the receiving position into an unlocking position. In the unlocking position, the lock unit is in the retaining unit at least in sections and can be easily transferred back to the receiving position. The tool itself preferably cannot be removed from the tool-holding device, even by the user.

Preferably, the lock unit has a fastening section for attaching the lock unit to the retaining unit. The fastening section is a defined section of the lock unit, with the aid of which the lock unit can be attached to the retaining unit so that the lock unit is secured only with this defined section on the retaining unit. In this case, the fastening section of the lock unit is favourably separated from the tool-holding section locally so that the tool can be arranged there easily, and, for example, the tool cannot be clamped onto the retaining unit accidentally.

In particular, a connection element is present, by means of which the lock unit is arranged on the retaining unit relative to this in a moveable manner. This connection element guarantees a compact connection between the lock unit and the retaining unit and allows for a reproducible transfer of the lock unit from the fixing position into the receiving position to take place.

Favourably, the retaining unit comprises a catch section at which the connection element is arranged. Thereby, the connection element can be designed as a pivot axis, wherein the lock unit is arranged on the retaining unit with the aid of the connection element. This improves the accessibility of the tool to the tool-holding section so that the user can easily arrange the tool there. Thereby, the connection element is formed, for example, as a bolt or as a joint.

Favourably, the lock unit with the tool-holding section is pivotably arranged on the retaining unit. This provides for a compact and reliable locking mechanism.

Preferably, the lock unit comprises an oblong hole with a longitudinal axis, wherein the lock unit can be linearly moved at least along the longitudinal axis of the oblong hole. Here, by linear movement, a movement at least into a spatial direction relative to the retaining unit is understood. The connection element can engage into the oblong hole, thereby guiding the lock unit in a reproduceable manner when moving along the oblong hole so that incorrect operation during handling can be avoided. For example, the lock unit moves at least along a defined vertical path of travel along the oblong hole, wherein the lock unit can be transferred from the fixing position into the unlocking position.

Preferably, the lock unit comprises a pre-tensioning section. The pre-tensioning section is locally separated from the tool-holding section. This allows a simple connection between the lock unit and the retaining unit, and a local separation from the tool section is given In particular, the pre-tensioning section comprises an elastic pre-tensioning element for easily fixing the lock unit on the retaining unit.

Favourably, the pre-tensioning element is designed to position the lock unit at its fixing position in a pre-tensioned manner. Thus, a compact connection between the lock unit and the retaining unit is possible since the tool-holding device does not therefore require an additional fixing element for fixing the lock unit on the retaining unit, and the lock unit is held in its fixing position stably in the end position.

In addition or as an alternative, the pre-tensioning element is designed to position the lock unit at its receiving position in a pre-tensioned manner. Thus, the lock unit is held in its receiving position stably in the end position.

Preferably, the pre-tensioning section is arranged between the tool-holding section and the fastening section. Thus, the fastening section and the pre-tensioning section are locally separated from the tool-holding section so that a compact and simple construction of the tool-holding device is possible, which can be operated by the user in a particularly simple manner.

Preferably, the receiving section of the retaining unit fully accommodates the lock unit, wherein the lock unit can be completely transferred in the fixing position. Thus, an improved holding of the lock unit in the retaining unit is possible, whereby the tool is stably arranged on the tool-holding device.

Favourably, the lock unit has a lock-unit length, which is dimensioned in such a way that the lock unit can be fully accommodated in the receiving section of the retaining unit. This makes it possible to implement a tool-holding device with a compact and space-saving design.

Preferably, the receiving section of the retaining unit comprises a holding section with a fixing stop for temporarily fixing the tool in the fixing position. The fixing stop prevents an independent or unwanted opening of the lock unit during operation of the work machine. The tool can rest in the fixing position on the holding section of the retaining unit at least selectively, thereby establishing an operative connection so that the tool can be easily fixed in the tool-holding section.

In particular, the retaining unit comprises a receiving stop, whereby the displacement or pivoting of the lock unit can be stopped in a reproducible manner when transferred into the receiving position. The receiving stop thus ensures a short distance of travel when transferring the lock unit from the receiving position into the fixing position so that this process step can be shortened with regard to the time involved.

Preferably, the holding section is wedge-shaped. Thus, the lock unit can slide along the wedge-shaped holding section as a guide rail at least in sections, whereby this can be transferred into the fixing position easily, for example, by simply pressing. Furthermore, the lock unit can slide independently along the wedge-shaped holding section when transferring into the receiving position.

Favourably, the wedge-shaped holding section comprises at least one defined wedge angle, wherein the lock unit conveniently slides into the receiving position during transfer. The wedge angle is dimensioned in such a way that the spring force of the elastic pre-tensioning element overcomes the static friction and/or the sliding friction between the lock unit and the retaining unit when transferring from the fixing position into the receiving position. Otherwise, the lock unit can slide along the wedge-shaped holding section back to the receiving position if the lock unit cannot be transferred into the fixing position. For example, this can be the case if an inappropriate or incorrect tool is arranged on the lock unit.

Preferably, the tool-holding section of the lock unit comprises at least one accommodating space for holding at least one tool. The tool can be arranged in it so that this is independently held at least at two support points in the accommodating space with the lock unit. In the fixing position of the lock unit, the tool is thereby fixed at at least three support points in the tool-holding device free of play, whereby a stable and play-free holding is made possible.

In particular, the accommodating space on the tool-holding section comprises a holding stop so that the lock unit can be held in the fixing position easily. In this case, the holding stop can be designed as a retaining lug, which has a defined retaining-lug length, whereby this is designed to be particularly simple on a constructional level.

Favourably, the holding stop is formed on the tool-holding section, to which the fixing stop on the holding section of the retaining unit at least temporarily establishes an operative connection. This allows the lock unit to be kept stable in the fixing position.

Favourably, the vertical path of travel along the oblong hole on the lock unit is greater than the retaining-lug length so that the lock unit can be transferred from the fixing position into the receiving position easily.

Favourably, the accommodating space on the tool-holding section is U-shaped. This allows, for example, for a tool with a cylindrical base body with a circular base-body diameter to be easily arranged in the accommodating space. Tools with a cylindrical base body can be arranged independently of a rotation of the tool around the cylinder longitudinal axis in the accommodating space, wherein, thereby, the accommodating space typically comprises an accommodating-space diameter.

Favourably, the lock unit comprises a lock-unit wall with a lock-unit wall thickness at least on the tool-holding section. This makes the tool capable of being stably held in the accommodating space.

Favourably, the lock unit can be transferred from the fixing position to the receiving position at least along an opening angle. This allows an efficient and reproducible pivoting of the lock unit along a defined pivot path.

In particular, the opening angle is defined with the aid of the lock-unit wall thickness, the accommodating-space diameter, the wedge angle and the lock-unit length, wherein the opening angle is defined as $$\text{opening angle } \beta > \tan^{-1}\left(\frac{\text{accommodating space diameter } c + \text{lock-unit wall thickness } d}{\text{lock-unit length } e}\right).$$

This allows for a minimum opening angle to be defined so that the tool can be easily arranged on the lock unit when this is in the receiving position.

Favourably, the wedge angle is greater than a friction angle, wherein the friction angle depends on the material characteristics of the lock unit/retaining unit pair. For example, the friction angle for a lock unit/retaining unit pair, which are both mode of steel, is 11.3 degrees. Thus, the lock unit can be transferred independently into the receiving position.

Favourably, the wedge angle is less than or equal to 90 degrees to it minus the opening angle so that a transfer of the lock unit to the receiving position can be easily carried out.

Preferably, the accommodating space on the tool-holding section comprises a tool coding. This means that only the tool that is approved by the tool coding can be allowed into the accommodating space. In other words, no tools can be arranged in the accommodating space that comprise a different coding from the tool coding. The coding mechanism is favourably bistable so that the lock unit along with the tool-holding section can only be transferred into the fixing position if a suitable tool is properly inserted into the accommodating space. Furthermore, such a tool coding allows for a self-centred arrangement of the tool in the tool-holding device.

Favourably, the tool coding in the accommodating space is designed as at least one projection, whereby a tool can be easily arranged on the tool-holding section in a positive-locking manner.

In particular, the tool coding has at least another projection. This allows the tool coding to be complex and tools with different codings are not accommodated in the accommodating space. This allows the user to recognize if the tool can be arranged without a direct view of the tool-holding section.

Preferably, an unlocking device for unlocking the lock unit is present. This allows the lock unit to be easily transferred from the fixing position into an unlocking position, for example, by the user using one hand, and an unintentional release is prevented.

In particular, the unlocking device is designed to transfer the lock unit from the receiving position into the fixing position. Thereby, a reproducible transferring of the lock unit from the fixing position into the receiving position is possible, which can be easily controlled by the user.

Preferably, the unlocking device comprises an unlocking pin, which is designed to counteract a pre-tensioning force at the lock unit. Thus, the unlocking device has a simple design, can be easily operated, and is arranged on the tool-holding device of the retaining unit in a space-saving manner.

In particular, the unlocking pin can be moved in the direction of the longitudinal axis of the oblong hole. This allows easy opening of the lock unit. Thereby, the unlocking pin can counter the pre-tensioning force on the lock unit in an efficient manner. In this case, the unlocking pin can be transferred from a holding position, where the lock unit is held in the retaining unit, into a release position, at which the lock unit is released.

In particular, the lock unit is in its unlocking position when the unlocking pin is in its release position. This allows for a particularly efficient unlocking device to be provided.

Favourably, the unlocking pin is bevelled at least at the side facing the lock unit so that the lock unit can slide along the bevel towards the receiving position and, in particular, the lock unit can be easily pivoted in the direction of the receiving position.

Preferably, the unlocking device comprises a return element for returning the unlocking pin from the release position into the holding position. Thereby, the unlocking pin can be controlled and can be transferred back into the holding position in a reproducible manner.

Favourably, the return element is designed as a spring element. Thus, the unlocking pin can be independently transferred back into the holding position via the return element with the aid of the spring force.

A work machine according to the invention comprises a tool-holding device as described here in the present case. In addition to the aforementioned advantages, the operational safety and thus the work safety for the operator of the work machine can be improved and are capable of being designed more simply on an ergonomic level than is the case with prior art, in particular, if the machine is designed as a cable processing machine.

Preferably, the retaining unit of the tool-holding device is arranged on the work machine in a detachable manner. Thus, the tool-holding device can be separated from the work machine and arranged at another work machine so that the field of application of the tool-holding device can be enlarged by means of a tool.

A method according to the invention for positioning a tool on a tool-holding device comprises at least the following steps:

opening a lock unit, wherein the lock unit is transferred from a fixing position into a receiving position for holding the tool;

arrangement of a tool on a tool-holding section of the lock unit, wherein the tool is then held in the tool-holding section in a pre-positioned manner;

closing the lock unit, wherein the lock unit together with the tool arranged in the tool-holding section is transferred from the receiving position into the fixing position.

The user of the work machine can easily position the tool into the tool-holding section of the lock unit with one hand, wherein the lock unit is in the receiving position during this positioning of the tool, and the tool is held in the tool-holding section in a pre-positioned manner. Thus, the tool can hold itself in a play-free manner on the tool-holding section of the lock unit before transferring the lock unit into the fixing position independently, for example, in a vertical position, without the user having to firmly hold the tool. Thereby, it is possible to arrange the tool on the lock unit without a direct view of the user on the tool-holding section. Pre-positioned holding the tool makes it easier for the user to change tools on the work machine, as it can prevent the tool from falling out of the tool-holding section. Thereby, ergonomic handling has been complied with. In particular, the tool-holding device previously described and also still to be described in the following is used for the method.

Preferably, when opening at step a), the lock unit is pivoted into the receiving position for holding the tool, wherein the lock unit is arranged on a retaining unit. The pivoting arrangement of the lock unit onto the retaining unit improves the accessibility of the tool to the tool-holding section so that the user can arrange the tool there without any problem.

Preferably, when closing the lock unit in step c), the lock unit is moved linearly and pivoted into the fixing position. A linearly moveable and pivoting lock unit makes a small and compact design of the tool-holding device possible.

Preferably, the tool in step b) is arranged on a tool coding in the accommodating space on the tool-holding section. This allows the tool to be kept self-centred in the holder. On the one hand, it can be prevented that an inappropriate or incorrect tool is placed in the accommodating space and, on the other hand, the use of the work machine is simplified for the user since a misarrangement of an unsuitable tool is preventable.

Preferably, before step a), the lock unit is transferred from the fixing position into an unlocking position. Thus, the lock unit is gradually transferred from position to position, thereby being transferred into the fixing position in a controlled manner.

Favourably, an unlocking device of the tool-holding device is actuated. The unlocking device prevents the lock unit from being transferred independently into the receiving position, thereby ensuring a reliable positioning of the tool on the work machine.

Preferably, when closing the lock unit, the lock unit slides in step c) along a wedge-shaped holding section of the retaining unit. This makes it easy to transfer the lock unit into the fixing position, for example, by simply pressing it.

Favourably, the lock unit slides independently along the wedge-shaped holding section into the receiving position when transferred into the receiving position. This mechanically supports or accelerates the process of opening the lock unit so that the tool is arranged in the accommodating space by the user in a timely manner.

Preferably, the tool is held in the tool-holding device by means of a three-point support in the fixing position free of play, wherein at least one first support point is present on a holding section of the retaining unit. Thus, the tool is in the fixing position with at least one first support point in an operative holding connection and is held in the tool-holding device in a stable and play-free manner.

In particular, the tool in the fixing position is pressed at least in sections onto the at least one first support point, whereby an improved operative holding connection is formed.

Further advantages, features and details of the invention arise from the following description, in which exemplary embodiments of the invention are described with reference to the drawings.

The reference list is also an integral part of the disclosure like the technical content of the patent claims and figures are. The figures are comprehensively described in relation to one another. Identical reference numbers denote identical components, and reference characters having different indices indicate functionally identical or similar components.

DETAILED DESCRIPTION OF THE PREFERRED EMBODIMENTS

Figure 1:
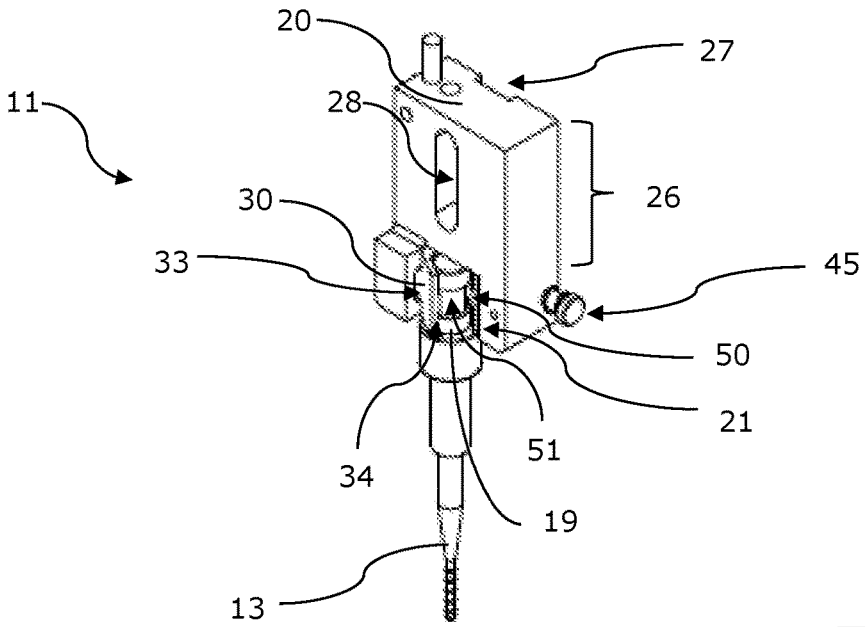
FIG. 1 a first embodiment of a tool-holding device according to the invention for a first tool in a perspective view, FIG. 2 the tool-holding device in accordance with FIG. 1, wherein the lock unit is in a fixing position in a sectional view, FIG. 3 the tool-holding device in accordance with FIG. 2, wherein the lock unit is in an unlocking position in a sectional view, FIG. 4 the tool-holding device in accordance with FIG. 2, wherein the lock unit is in a receiving position in sectional view, FIG. 5 another embodiment of the tool-holding device for another tool in a perspective view, FIG. 6 the tool-holding device in accordance with FIG. 5 for the other tool in a sectional view, FIG. 7 another embodiment of the tool-holding device for another tool in a perspective view, FIG. 8 the tool-holding device in accordance with FIG. 7 for the other tool in a sectional view, FIG. 9 another embodiment of the tool-holding device for the first tool in a perspective view, FIG. 10 the tool-holding device in accordance with FIG. 9 without a tool, wherein the lock unit is in the receiving position in a sectional view, FIG. 11 the tool-holding device in accordance with FIG. 10 without tools, wherein the lock unit is in an unlocking position in a sectional view, FIG. 12 the tool-holding device in accordance with FIG. 10 without a tool, wherein the lock unit is in a fixing position in a sectional view, FIG. 13 the tool-holding device in accordance with FIG. 10 with a tool, wherein the lock unit lock unit is in the receiving position in a sectional view, FIG. 14 the tool-holding device in accordance with FIG. 10 with a tool, wherein the lock unit is in an unlocking position in a sectional view, FIG. 15 the tool-holding device in accordance with FIG. 10 with a tool, wherein the lock unit is in a fixing position in a sectional view, and FIG. 16 a work machine according to the invention with a tool-holding device in accordance with FIG. 1 in a perspective view.

FIG. 1 to FIG. 4 show a tool-holding device 11 for holding a tool 13. The tool-holding device 11 comprises a retaining unit 20 and a lock unit 30. A receiving section 21 for holding the lock unit 30 is arranged on the retaining unit 20, wherein the receiving section 21 comprises a holding section 23 and a fixing stop 25 for temporarily fixing the lock unit 30 in a fixing position. In the fixing position, the lock unit 30 is completely arranged in the receiving section 21. The fixing stop 25 prevents an independent or undesirable opening of the lock unit 30 at a work machine during operation. The holding section 23 is wedge-shaped so that the lock unit 30 can slide along the wedge-shaped holding section 23 at least in sections when closing.

Furthermore, a receiving stop 22 is provided on the retaining unit 20 for positioning the lock unit 30 in the receiving position. Thereby, the lock unit 30 is stopped when transferred to the receiving position, wherein the lock unit 30 abuts the receiving stop 22 in sections. The retaining unit 20 additionally comprises a positioning section 26 for positioning the tool-holding device 11 on a work machine. An oblong positioning hole 28 and a positioning joint 27 are present on the positioning section 26, by means of which the retaining unit 20 can be positioned along the longitudinal extension of the positioning oblong hole 28 in an adjustable and is also arranged on the work machine in a detachable manner. Furthermore, the retaining unit 20 comprises a catch section 24, on which a connection element 29 is arranged, which is designed as a bolt here.

The lock unit 30 comprises a tool-holding section 33 with an accommodating space 34 for holding and the pre-positioned holding of the tool 13, which is designed here as an impact tool (see FIG. 1) in the present case. In the present case, by a pre-positioned holding, an independent holding of the tool 13 in the tool-holding section 33 of the lock unit 30 is understood, which is held in the tool-holding section 33 in a pre-positioned manner. In particular, an impact tool is designed to exert compression force onto a workpiece.

The lock unit 30 furthermore comprises a fastening section 35 for attaching the lock unit 30 on the retaining unit 20, as well as a pre-tensioning section 37. In this case, the fastening section 35 is separated from the tool-holding section 33 and the pre-tensioning section 37 locally, wherein the pre-tensioning section 37 is arranged between the fastening section 35 and the tool-holding section 33.

An elastic pre-tensioning element 39 is arranged in the pre-tensioning section 37. The elastic pre-tensioning element 39 is designed to position the lock unit 30 at the fixing position as well as in the receiving position in the retaining unit 30 in a pre-tensioned manner. In accordance with this embodiment of the tool-holding device 11, a helical spring is provided as an elastic pre-tensioning element 39.

The lock unit 30 can be transferred from the fixing position (FIG. 2) into an unlocking position (FIG. 3) and further into a receiving position (FIG. 4) and, in reverse order, back into the fixing position. The embodiment of the tool-holding devices shown here illustrates a pivoting lock unit 30.

The lock unit 30 comprises an oblong hole 40 with a longitudinal axis 41, wherein the lock unit 30 can be linearly moved along the longitudinal axis 41 of the oblong hole 40. The connection element 29 is designed as a pivoting aid, wherein the lock unit 30 is positioned on the retaining unit 30 with the aid of the connection element 29, and the lock unit 30 with the tool-holding section 33 can be pivoted around the connection element 29. The connection element 29 of the retaining unit 20 thereby engages into the oblong hole 40 of the lock unit 30 and can be moved along a defined vertical path of travel in the oblong hole 40.

The accommodating space 34 on the tool-holding section 33 is U-shaped and comprises a holding stop 36 so that the lock unit 30 can be easily held in the fixing position. The holding stop 36 shown is designed as a section of the lock-unit wall 31 in the region of the accommodating space 34. The holding stop 36 is formed in order to establish an operative connection with the fixing stop 25 on the holding section 23 of the retaining unit 20 at least temporarily, i.e. at least in the fixing position of the lock unit 30. The holding stop 36 rests touching on the fixing stop 25.

The tool-holding device 11 comprises an unlocking device 45 for unlocking the lock unit 30. The unlocking device 45 is arranged on the retaining unit 20 and is designed to transfer the lock unit 30 from the receiving position into the unlocking position. The unlocking device 45 comprises an unlocking pin 46, which can be transferred from a holding position (FIG. 2) into an release position (FIG. 3), and which is designed to counteract the pre-tensioning force of the elastic pre-tensioning element 39 on the lock unit 30. The unlocking pin 46 can be moved in the direction of the longitudinal axis 41 of the oblong hole 40. The unlocking pin 46 is bevelled on side facing the lock unit 30 so that the lock unit 30 can slide along the bevel 49 towards the receiving position. The unlocking device 45 here comprises a helical spring as a return element 47 for returning the unlocking pin 46 from the release position into the holding position. If the unlocking pin 46 is transferred from the holding position into release position, then, the lock unit 30 is also transferred from the fixing position to its unlocking position (see FIG. 3). An unlocking-pin safeguard 48 is arranged on the retaining unit 30 as a bolt safeguard so that an undesirable separation of the unlocking pin 46 from the retaining unit 20 can be prevented, and the bevel 49 from the unlocking pin 46 is always correctly orientated towards the lock unit 30. The previously defined vertical path of travel of the connection element 29 extends substantially along the longitudinal axis 41 in the oblong hole 40 so that the lock unit 30 can then be pivoted from the unlocking position into the receiving position.

The tool 13 shown in FIG. 1 to FIG. 4 comprises a cylindrical base body 19 with a circular base-body diameter so that this can be easily arranged into the U-shaped accommodating space 34. Both the tool 13 as well as the accommodating space 34 on the tool-holding section 33 of the shown tool-holding device 11 each comprise a tool coding 50 or 51.

Figure 2:
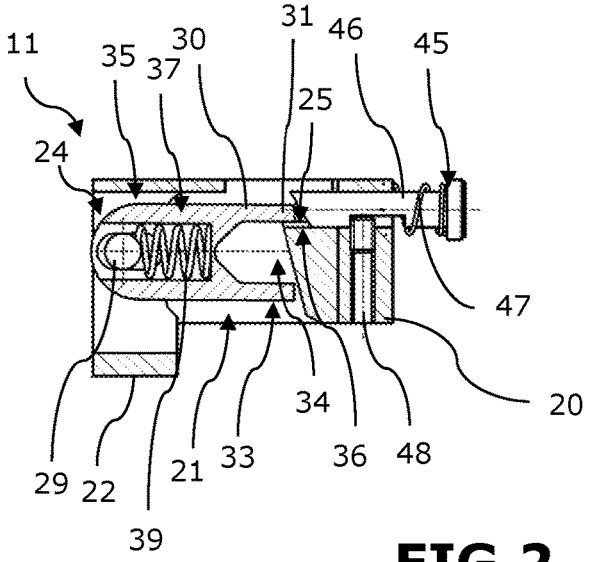
Figure 3:
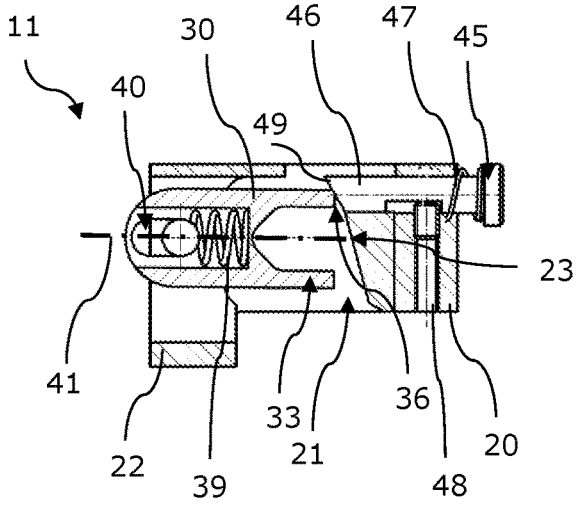
Figure 4:
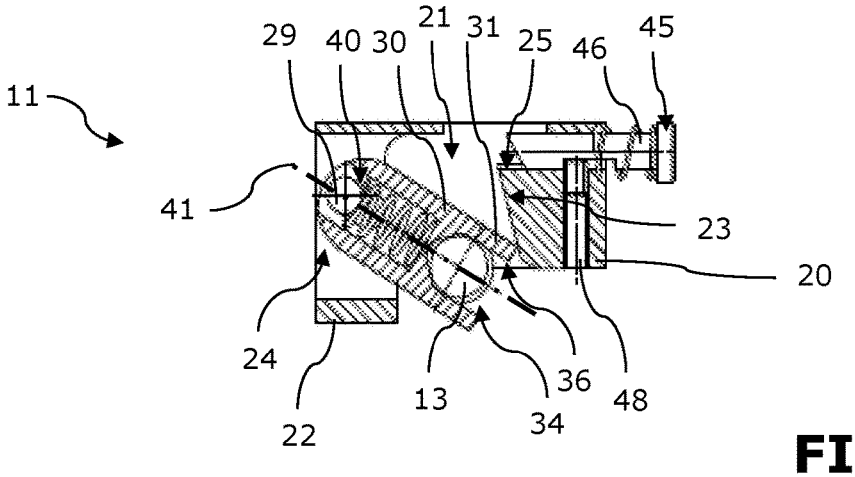

Based on the FIGS. 2 to 4, a method for positioning a tool 13 on the tool-holding device 11 is now shown in the following.

The method entails opening the lock unit 30, wherein the lock unit 30 can be transferred from the fixing position into a receiving position for holding the tool 13 (step a). During this transfer, the lock unit 30 is initially moved linearly from the fixing position (FIG. 2) into the unlocking position (FIG. 3) along the longitudinal axis 41 and then pivoted into the receiving position (FIG. 4). The transfer is carried out by means of the unlocking device 45, which is manually operated by the user of the tool-holding devices 11. For this purpose, the unlocking device 45 comprises an unlocking pin 46, which is arranged at the retaining unit 20 and by means of which the lock unit 30 is moved into the unlocking position. In this case, the unlocking pin 46 is initially in its holding position (FIG. 2), in which the lock unit 30 is held in the retaining unit 20 and is subsequently transferred into its release position (FIG. 3) where the lock unit 30 is released. During this transfer, the unlocking pin 46 counteracts the pre-tensioning force at the lock unit 30 and exceeds this pre-tensioning force. Thereby, the return element 47, which is designed as a helical spring, is compressed. Simultaneously, the elastic pre-tensioning element 39 is compressed in the pre-tensioning section 37 and the operative connection between the holding stop 36 on the tool-holding section 33 and the fixing stop 25 on the holding section 23 of the retaining unit 20 is detached (FIG. 3). Thereby, the connection element 29 is linearly moved along the oblong hole 40 towards the accommodating space 34 to the unlocking position.

Subsequently, the lock unit 30 slides along the wedge-shaped holding section 23 of the retaining unit 20 in its receiving position, wherein the pivot movement of the lock unit 30 by the receiving stop 22 of the retaining unit 20 is stopped. In the following, the unlocking pin 46 is subsequently transferred with the aid of the return element 47 from its release position (FIG. 3) in its holding position (FIG. 4), wherein the return element 47 is relaxed. When sliding the lock unit 30 along the wedge-shaped holding section 23 of the retaining unit 20, the connection element 29 moves linearly along the oblong hole 40 in the opposite direction away from the accommodating space 34, wherein the elastic pre-tensioning element 39 is relaxed.

Subsequently, the tool 13 is arranged on the tool-holding section 33 of the lock unit 30, wherein the tool 13 is held in the tool-holding section 33 in a pre-positioned manner ((step b); FIG. 4). A tool 13 held in a pre-positioned manner in the accommodating space 34 of the tool-holding section 33 is shown in the FIG. 1.

Finally, the closing of the lock unit 30 is carried out, wherein the lock unit 30 is transferred along with the tool 13 arranged in the tool-holding section 33 are transferred from the receiving position (FIG. 4) into the fixing position (FIG. 2) (step c). Thereby, the lock unit 30 with the tool 13 arranged therein initially slides along the wedge-shaped holding section 23 into the unlocking position (FIG. 3) and is then moved linearly with the aid of the elastic pre-tensioning element 39 into the fixing position (FIG. 2).

Figure 5:
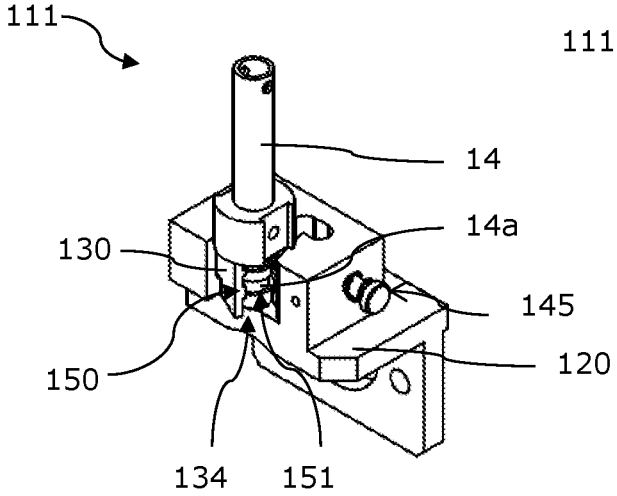
Figure 6:
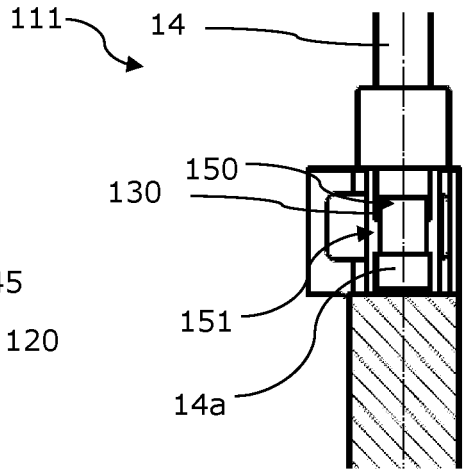
Figure 7:
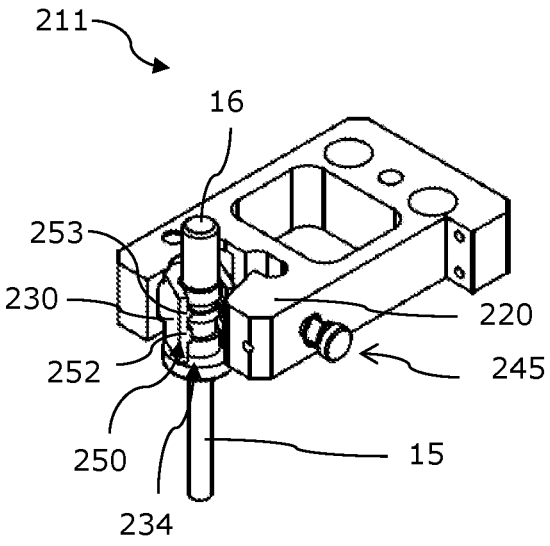
Figure 8:
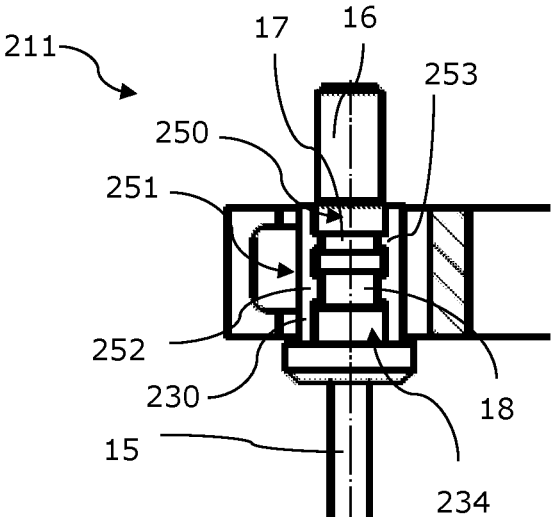
Figure 9:
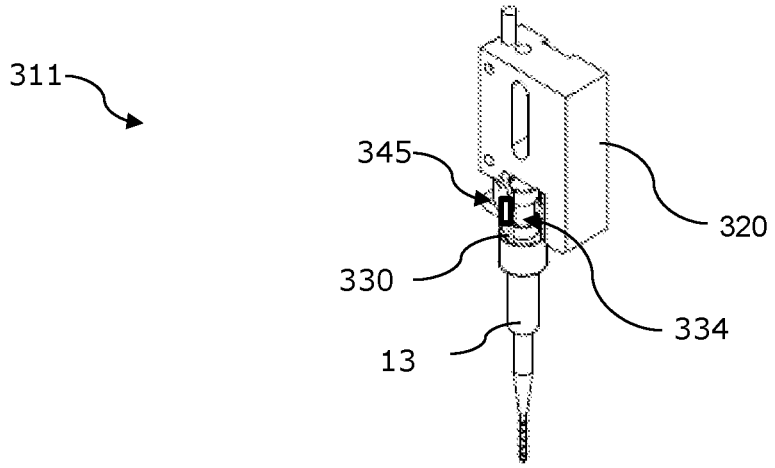
Figure 10:
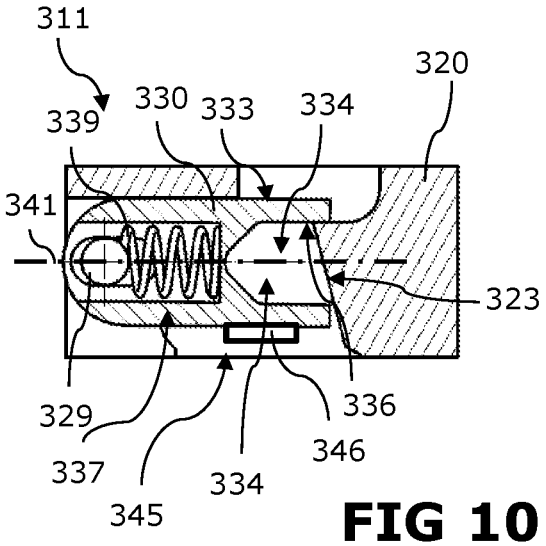

The previously shown method for positioning a tool 13 on a work machine with a tool-holding device 11 can be carried out both with the aid of the tool-holding device 11 in accordance with FIGS. 1 to 4, as well as with the aid of the tool-holding device 111 in accordance with FIG. 5 and FIG. 6, or the tool-holding device 211 in accordance with FIG. 7 and FIG. 8.

FIG. 5 and FIG. 6 show another tool-holding device 111, which is essentially designed as the previously described tool-holding device 11. The tool-holding device 111 in accordance with FIG. 5 and FIG. 6 differs, for example, from the tool-holding device 11 in accordance with FIG. 1 to FIG. 4 in that a different tool 14 can be arranged in the accommodating space 134 of the lock unit 130. The lock unit 130 is arranged in the retaining unit 120 of the tool-holding device 111, wherein the retaining unit 120 has constructional differences to the retaining unit 20. Otherwise, this tool-holding device 111 has the previously described constructive and functional features to a great extent. The tool shown here 14 also comprises a cylindrical base body 14a with a circular base-body diameter so that this can be easily arranged in the U-shaped accommodating space 134. The tool codings 150 and 151 on the tool-holding devices 111 are complementary to each other so that only one tool 14 with its corresponding tool codings 150 can be arranged in the accommodating space 134 with the tool codings 151. In other words, no tools are accepted in the accommodating space 134, which comprise a tool coding 150 that is non-complementary to tool coding 151. The shown tool coding 150 on the tool 14 is designed with different diameters on the cylindrical base body of the tool 14. The shown tool coding 151 in the accommodating space 134 is formed by the projections complementary thereto in the accommodating space 134. The previously described unlocking device 145 is arranged on the retaining unit 120.

FIG. 7 and FIG. 8 show another tool-holding device 211, which is essentially designed as the previously described tool-holding device 11 or 111. The tool-holding device 211 in accordance with FIG. 7 and FIG. 8 differs, for example, from the tool-holding device 11 in accordance with FIG. 1 to FIG. 4 in that a different tool can be arranged in the accommodating space 234 of the lock unit 230. Otherwise, this tool-holding device 211 largely comprises the previously described features. The lock unit 230 is arranged in the retaining unit 220 of the tool-holding device 211. The accommodating space 234 of the lock unit 230 comprises another tool coding 250 or 251 with two projections 252 and 253, which extend towards the accommodating-space centre of the accommodating space 234. The two projections 252 and 253 have different projection thicknesses, whereby the tool coding 250 is specified. The shown tool 15 comprises two recesses 17 and 18 on its cylindrical base body 16, which are complementary to the projections 252 and 253. The previously described unlocking device 245 is arranged on the retaining unit 220.

Tool codings, which are designed differently to the previously shown tool codings, can also be used in the embodiments of the tool-holding device shown here. In particular, if the accommodating space on the lock unit is, for example, square-shaped and/or polygonal. For example, a tool with a base body that has a corresponding square or rectangular base-body cross-section can be arranged (not shown).

FIG. 9 to FIG. 15 show a tool-holding device 311 as another embodiment of the tool-holding device 11 in accordance with FIG. 1 to FIG. 4. Thereby, this tool-holding device 311 largely comprises the same features or components, as already shown previously. The tool-holding device 311 does not show a receiving stop, wherein, however, this could also be present on this tool-holding device 311. The tool-holding device 311 comprises an unlocking device 345, which differs from the previously shown unlocking device in accordance with FIG. 1 to FIG. 4 with regard to its structure, however not with regards to its functionality. The unlocking device 345 is arranged here on the lock unit 330.

Based on the FIG. 10 to FIG. 15, another method for positioning a tool 13 on a tool-holding device 311 is now shown in the following. In this case, the tool-holding device 311, as previously shown, comprises a lock unit 330 and a retaining unit 220, wherein the lock unit 330 is arranged in its fixing position in the receiving section 321 of the retaining unit. The method shown in the following for positioning a tool 13 on a work machine with a tool-holding device 311 can be carried out both with the aid of the tool-holding device 11 in accordance with FIGS. 1 to 4, as well as with the aid of the tool-holding device 111 in accordance with FIG. 5 and FIG. 6, or the tool-holding device 211 in accordance with FIG. 7 and FIG. 8.

Figure 11:
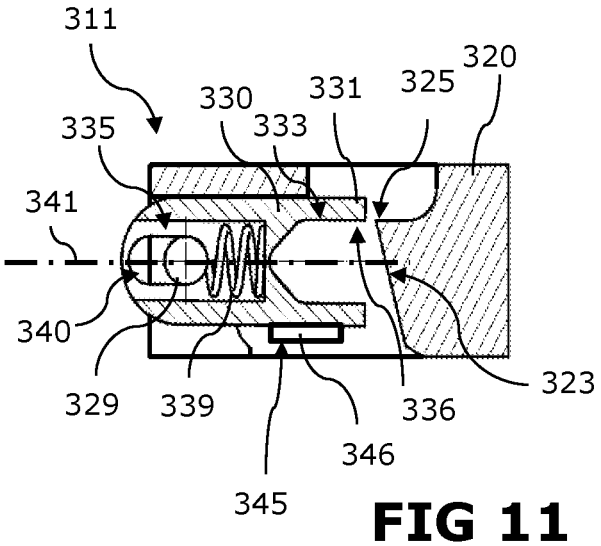
Figure 12:
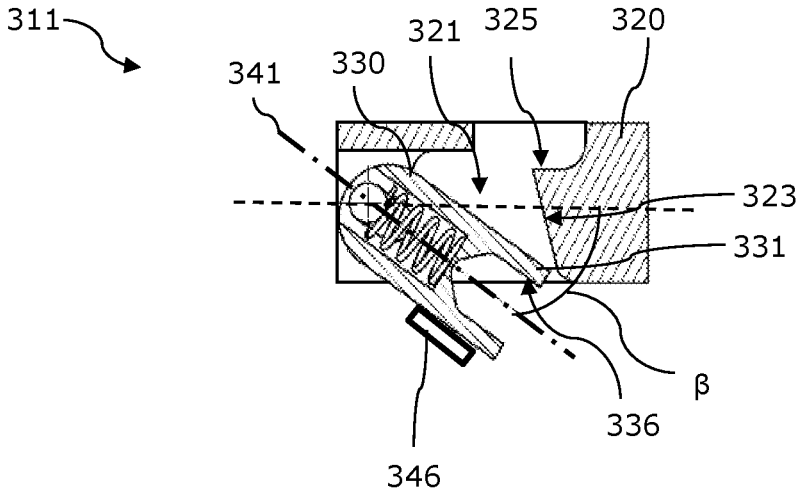

The method entails opening the lock unit 330, wherein the lock unit 330 can be transferred from the fixing position into a receiving position for holding the tool 13 (step a). During this transfer, the lock unit 330 is initially moved linearly from the fixing position (FIG. 10) into the unlocking position (FIG. 11) along the longitudinal axis 341 and then pivoted into the receiving position (FIG. 12). The transfer is carried out by means of the unlocking device 345, which is manually operated by the user of the tool-holding devices 311. The unlocking device 345 comprises an unlocking pin 346, which is arranged on the lock unit 330 and by means of which the lock unit 330 is moved into the unlocking position. Thereby, the pre-tensioning element 339, which is designed here as a helical spring, is compressed in the pre-tensioning section 337 and the operative connection between the holding stop 336 at the tool-holding section 333 and the fixing stop 325 on the holding section 323 of the retaining unit 320 is detached (FIG. 11). The pre-tensioning section 337 is arranged between the fastening section 335 and the tool-holding section 333 at the lock unit 330.

Simultaneously, the connection element 329 is linearly moved along the oblong hole 340 in the direction of the accommodating space 334 towards the unlocking position.

Subsequently, the lock unit 330 slides along the wedge-shaped holding section 323 of the retaining unit 320 in its receiving position. In this case, the wedge-shaped holding section 323 comprises a wedge angle $\alpha$, wherein the lock unit 330 slides along the wedge-shaped holding section 323 when transferring into the receiving position with the lock-unit wall 331. When opening, the lock unit 330 is thereby pivoted from the unlocking position to the receiving position along the opening angle. The opening angle β is described with the aid of the lock-unit wall thickness d, the accommodating-space diameter c, the wedge angle α and the lock-unit length e, wherein the opening angle β is defined with $$\text{opening angle } \beta > \tan^{-1}\left(\frac{\text{accommodating space diameter } c + \text{lock-unit wall thickness } d}{\text{lock-unit length } e}\right).$$

When sliding the lock unit 330 along the wedge angle a, the elastic pre-tensioning element 339 is pushed apart again so that the connection element 329 is moved along the longitudinal axis 341 in the oblong hole 340. This previously described construction of the retaining unit 330 including the functional features can also be used in the embodiments of the tool-holding devices in accordance with FIG. 1 to FIG. 8 and complement the previously described methods.

Figure 13:
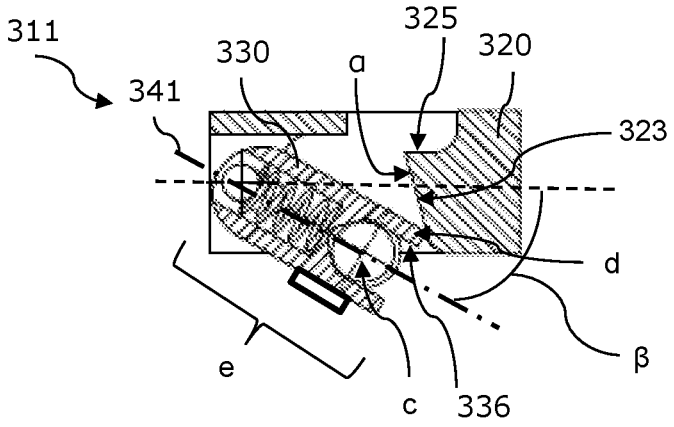
Figure 14:
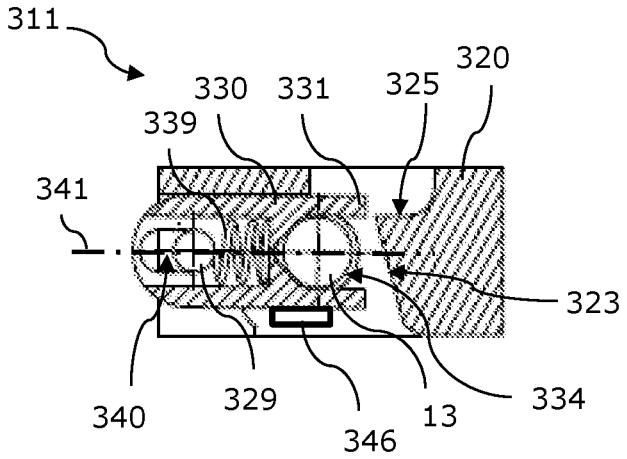

Subsequently, the tool 13 is arranged on the tool-holding section 333 of the lock unit 330, wherein the tool 13 is held in the tool-holding section 333 in a pre-positioned manner (step b); (FIG. 13). A tool 13 held in a self-locking manner in the accommodating space 334 of the tool-holding section 333 is shown in the FIG. 9.

In conclusion, the closing of the lock unit 330 takes place, wherein the lock unit 330 along with the tool 13 arranged in the tool-holding section 333 are transferred from the receiving position (FIG. 13) into the fixing position (FIG. 15) (step c). Thereby, the lock unit 330 initially slides along the wedge-shaped holding section 323 into the unlocking position (FIG. 14) and is then moved linearly with the aid of the elastic pre-tensioning element 339 into the fixing position (FIG. 15).

Figure 15:
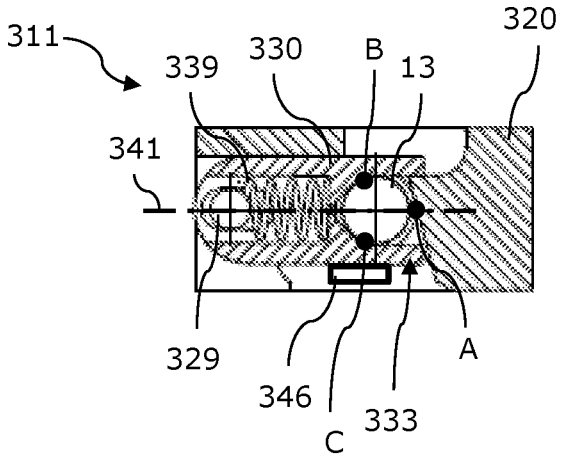

FIG. 15 shows the tool-holding device 311, wherein the lock unit 330 along with the tool 13 are in the fixing position. Thereby, the tool 13 is held in the tool-holding device 311 in the fixing position with the aid of a three-point support. A first support point A is on the holding section 323 of the retaining unit 320, wherein the tool 13 is pressed to the first support point A in the fixing position. Further support points B and C are in the accommodating space 334 of the lock unit 330, wherein the tool 13 is thereby pressed in the fixing position onto the support points B and C. This structure along with the three-point support of the tool in the fixing position can also be present in the aforementioned embodiments of the tool-holding device 11 or 111 or 211.

Figure 16:
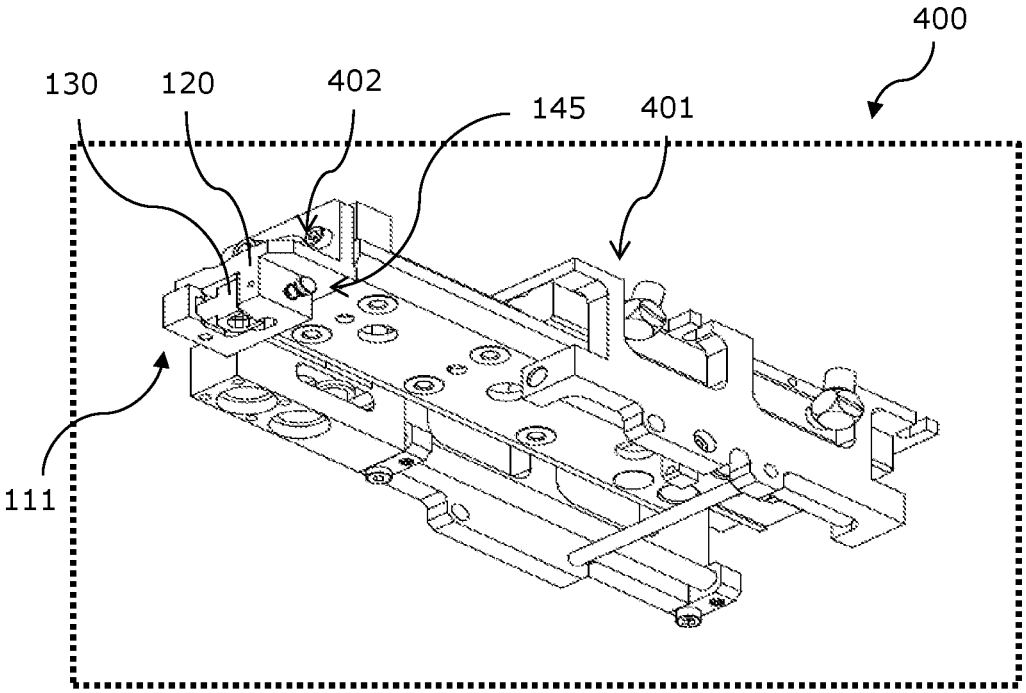

FIG. 16 shows a cable processing machine 400 as a work machine with the tool-holding device 111 in accordance with FIG. 5 to FIG. 6 and with a fastening device 401. Alternatively to this, the previously shown tool-holding device 11 or 211 or 311 can also be arranged on the fastening device 401. The tool-holding device 111 comprises the retaining unit 120 and the lock unit 130 as well as the unlocking device 145, as described above, and is arranged on the fastening device 401 of the cable processing machine 400 in a detachable manner, wherein fastening means 402 are present for detaching the tool-holding device 111.

Reference List

11 tool-holding device
13 tool
14 other tool
14*a* cylindrical base body of 14
15 other tool
16 cylindrical base body of 15
17 first recess of 15
18 second recess of 15
19 cylindrical base body of 13
20 retaining unit
21 receiving section
22 receiving stop
23 holding section
24 catch section
25 fixing stop
26 positioning section
27 positioning joint
28 oblong positioning hole
29 connection element
30 lock unit
31 lock-unit wall
33 tool-holding section
34 accommodating space
35 fastening section
36 first holding stop
37 pre-tensioning section
38
39 elastic pre-tensioning element
40 oblong hole
41 longitudinal axis
45 unlocking device
46 unlocking pin
47 return element
48 unlocking-pin safeguard
49 bevel of 46
50 tool coding in 34
51 tool coding of 13
111 tool-holding device
120 retaining unit
130 lock unit
134 accommodating space
145 unlocking device
150 tool coding in 134
151 tool coding of 14
211 tool-holding device
220 retaining unit
230 lock unit
234 accommodating space
245 unlocking device
250 tool coding in 134
251 tool coding of 15
252 first projection of 251
253 second projection of 251
311 tool-holding device
320 retaining unit
321 receiving section
323 holding section
325 fixing stop
329 connection element
330 lock unit
333 tool-holding section
334 accommodating space
335 fastening section
336 holding stop

337 pre-tensioning section
339 elastic pre-tensioning element
340 oblong hole
341 longitudinal axis
346 unlocking pin
400 work machine
401 fastening device
402 fastening means
α wedge angle
β opening angle
c accommodating-space diameter
d lock-unit wall thickness
e lock-unit length
A-C support points

The invention claimed is:

1. A tool-holding device (11; 111; 211; 311) for holding a tool (13; 14; 15) on a cable processing machine, with a retaining unit (20; 120; 220; 320) and with a lock unit (30; 130; 230; 330), wherein the lock unit (30; 130; 230; 330) can be transferred from a receiving position into a fixing position and the retaining unit (20; 120; 220; 320) comprises a receiving section (21; 321) for holding the lock unit (30; 130; 230; 330) at least in sections, and the lock unit (30; 130; 230; 330) comprises a tool-holding section (33; 333) for a pre-positioned holding of a tool (13; 14; 15), wherein the tool-holding section (33: 333) holds the tool (13: 14: 15), prior to transferring the lock unit (30: 130: 230: 330) into the fixing position, independently and self-lockingly in position, wherein the lock unit (30; 130; 230; 330) comprises a fastening section (35; 335) for attaching the lock unit (30; 130; 230; 330) on the retaining unit (20; 120; 220; 320), a connection element (29; 329) is present, by which the lock unit (30; 130; 230; 330) is arranged on the retaining unit (20; 120; 220; 320) relative to this in a moveable manner, and the lock unit (30; 130; 230; 330) with the tool-holding section (33; 333) is pivotably arranged on the retaining unit (20; 120; 220; 320).

2. A tool-holding device according to claim 1, wherein the lock unit (30; 130; 230; 330) comprises an oblong hole (40; 340) with a longitudinal axis, and the lock unit (30; 130; 230; 330) can be linearly moved at least along the longitudinal axis (41; 341) of the oblong hole (40; 340).

3. The tool-holding device according to claim 1, wherein the lock unit (30; 130; 230; 330) comprises a pre-tensioning section (37; 337), the pre-tensioning section (37; 337) comprises an elastic pre-tensioning element (39; 339), and the pre-tensioning element (39; 339) is designed to position the lock unit (30; 130; 230; 330) at the fixing position and/or at the receiving position in a pre-tensioned manner.

4. The tool-holding device according to claim 3, wherein the pre-tensioning section (37) is arranged between the tool-holding section (33, 333) and a fastening section (35; 335) of the lock unit.

5. The tool-holding device according to claim 1, wherein the receiving section (21; 321) of the retaining unit (20; 120; 220; 320) fully accommodates the lock unit (30; 130; 230; 330).

6. The tool-holding device according to claim 1, wherein the receiving section (21; 321) of the retaining unit (20; 120; 220; 320) comprises a holding section (23; 323) with a fixing stop (25; 325) for temporarily fixing the tool (13; 14; 15) in the fixing position, the retaining unit (20; 120; 220; 320) comprises a receiving stop (22), and the holding section (23; 323) is wedge-shaped.

7. The tool-holding device according to claim 1, wherein the tool-holding section (33; 333) of the lock unit (30; 130; 230; 330) comprises at least one accommodating space (34; 334) for holding at least one tool (13; 14; 15), the accommodating space (34; 334) on the tool-holding section (33; 333) comprises a holding stop (36; 336), which is designed to establish an operative connection to a fixing stop (25; 325) on the holding section (23; 323) of the retaining unit (20; 120; 220; 320) at least temporarily, and the accommodating space (34; 334) on the tool-holding section (33; 333) is U-shaped.

8. The tool-holding device according to claim 7, wherein the accommodating space (34; 334) on the tool-holding section (33; 333) comprises a tool coding (50; 150; 250).

9. The tool-holding device claim 1, wherein an unlocking device (45; 345) for unlocking the lock unit (30; 130; 230; 330) is present, and the unlocking device (45; 345) is designed to transfer the lock unit (30; 130; 230; 330) from the fixing position into the receiving position.

10. The tool-holding device according to claim 9, wherein the unlocking device (45; 345) comprises an unlocking pin (46; 346), which is designed to counteract a pre-tensioning force on the lock unit (30; 130; 230; 330), and the unlocking pin (46; 346) can be moved in a direction of a longitudinal axis of an oblong hole (40; 340).

11. The tool-holding device according to claim 10, wherein the unlocking device (45; 345) comprises a return element (47) for returning the unlocking pin (46; 346) from an release position to a holding position, and the return element (47; 347) is designed as a spring element (48; 348).

12. A cable processing machine (400) with a tool-holding device (11; 111; 211; 311) according to claim 1.

13. The cable processing machine according to claim 12 wherein the retaining unit (20; 120; 220; 320) of the tool-holding device (11; 111; 211; 311) is arranged in a detachable manner.

14. A method for positioning a tool (13; 14; 15) on a tool-holding device with a tool-holding device (11; 111; 211; 311) according to claim 1, wherein the method comprises the following steps:

a) opening a lock unit (30; 130; 230; 330), and the lock unit (30; 130; 230; 330) is transferred from a fixing position into a receiving position for holding the tool (13; 14; 15);

b) arrangement of a tool (13; 14; 15) on a tool-holding section (33; 333) of the lock unit (30; 130; 230; 330), and the tool (13; 14; 15) is then held in the tool-holding section (33; 333) in a pre-positioned manner, wherein the tool-holding section (33: 333) hold the tool (13: 14: 15), prior to transferring the lock unit (30: 130: 230: 330) into the fixing position, independently and self-lockingly in position;

c) closing the lock unit (30; 130; 230; 330), and the lock unit (30; 130; 230; 330) along with the tool (13; 14; 15) arranged in the tool-holding section (33; 333) are transferred from the receiving position into the fixing position.

* * * * *